United States Patent [19]

Galloway et al.

[11] Patent Number: 4,550,311

[45] Date of Patent: Oct. 29, 1985

[54] REMOTE SENSING SYSTEMS

[75] Inventors: John L. Galloway, Edinburgh; Timothy R. F. Hankins, Balerno; Ian A. Owers, Kirkliston, all of Scotland

[73] Assignee: Racal Security Limited, Newbridge, Scotland

[21] Appl. No.: 556,915

[22] Filed: Dec. 1, 1983

[30] Foreign Application Priority Data

Dec. 2, 1982 [GB] United Kingdom ..... 8234443

[51] Int. Cl.[4] ..... G08B 1/00

[52] U.S. Cl. ..... 340/531; 340/506; 340/536; 340/539; 340/346; 455/56

[58] Field of Search ..... 340/531, 539, 506, 536, 340/538, 825.31, 825.32, 825.47, 825.69, 825.72, 825.75, 825.04, 825.44, 345, 346; 455/9, 39, 33, 49, 53, 54, 67, 63, 65, 56

[56] References Cited

U.S. PATENT DOCUMENTS 3,445,815 5/1969 Saltzberg et al. ..... 340/825.54

4,005,428 1/1977 Graham ..... 340/825.75

4,191,948 3/1980 Stockdale ..... 340/539

*Primary Examiner*—Donnie L. Crosland

*Attorney, Agent, or Firm*—Leydig, Voit & Mayer, Ltd.

[57] ABSTRACT

A security installation at one Site has remote sensors which detect intrusion, fire, etc. and transmit corresponding signals by radio to a master station. Similar installations are provided at other Sites. The sensors of each Site precede their data signals with an access code which is particular to that Site and prevents their signals being received by the master station of any adjacent Site within radio range. When a new installation is to be installed at a new, adjacent Site, an arbitrary value is initially selected for its access code and the master station there transmits a special code to all adjacent Sites. In response to this special code, the master station in each such adjacent Site transmits its own access code back to the new installation, where it is compared in value with the arbitrarily selected access code. The latter is automatically changed until it becomes different from that of any and all adjacent Sites. The remote sensors of the new installation are then set to this value.

17 Claims, 7 Drawing Figures

REMOTE SENSING SYSTEMS

BACKGROUND OF THE INVENTION

The invention relates to remote sensing systems, that is, systems having one or more sensors for sensing particular parameters or changes in such parameters and which are remote from a station which is intended to respond to information received from the sensor or sensors. One particular example of such a system is a security system in which there are a plurality of sensors situated at different positions in an area to be monitored (such as a building or house or part of a building such as a flat or apartment) and arranged to sense (for example) the presence of an intruder, the movement of an object, fire or smoke or inadvertent escape of a substance such as gas or water, each sensor being arranged to transmit signals representative of what it is sensing to a master station which is in or near the area being monitored and which then responds by taking appropriate action such as emitting a warning signal or causing such a signal to be transmitted to a distant location (as by means of a telephone line).

Many different forms of such security installations are known. It is common to instal such systems by connecting each sensor to the master station by wired links, the wires feeding power to the sensors and transmitting signals from them to the master station. Such arrangements have the advantage of providing secure and substantially interference-free transmission of signals. However, they are expensive to instal, mainly because of the problems involved in installing the wired links and, if these are not installed properly, they may be unacceptably unsightly.

It has been proposed to deal with this problem by using wireless links between sensors and the master station, so that signals are transmitted from the sensors to the master station by radio. If each sensor is, in addition, powered by its own battery, installation is very considerably simplified because, of course, there is no longer any need to instal wired links between each sensor and the master station. However, although the sensors are arranged to radiate their signals with low power (and this is normally required by Government regulations), it may be impossible (in an apartment block for example) to avoid signals radiated by the sensors in an installation in one apartment from reaching the master station of the installation in an adjacent apartment. It is therefore necessary to ensure that each master station only responds to signals from its own sensors.

However, the problem of signals radiated by the sensors in one installation reaching the master station of another installation can arise not only in systems transmitting signals by radio but also sometimes in systems transmitting signals in other ways, such as by means of infra-red radiation, ultrasonic vibrations or any other suitable means, including also by means of wired links and in particular in an AC line carrier system, that is where transmission is by the power supply mains.

SUMMARY OF THE INVENTION

According to the invention, there is provided a remote sensing system, comprising a group of remote units associated with a master station and for transmitting information to that master station and for installation within reception range of one or more other similar groups of remote units each associated with a respective said master station and for transmitting information to the respective master station, the information transmitted by the remote units of each said other group being identified with a respective access code which is recognizable only by the master station of the associated remote units, including monitoring means to cause the access code applicable to each of the said other groups to be monitored by radio, and selecting means at the said location and responsive to the monitored access codes for selecting a different value of access code for the first-mentioned master station.

According to the invention, there is also provided a method of preventing interference between adjacent installations each comprising a respective group of remote stations which transmit information to a respective master station by means of signals which are identified by an access code, comprising the steps of causing the access codes of all installations within reception range of the location of a proposed new installation to be automatically monitored, and automatically selecting for the proposed new installation a value of access code which is different from the monitored access codes.

DESCRIPTION OF THE DRAWINGS

Security systems embodying the invention will now be described, by way of example only, with reference to the accompanying diagrammatic drawings in which.

DESCRIPTION OF PREFERRED EMBODIMENTS

Figure 1A:
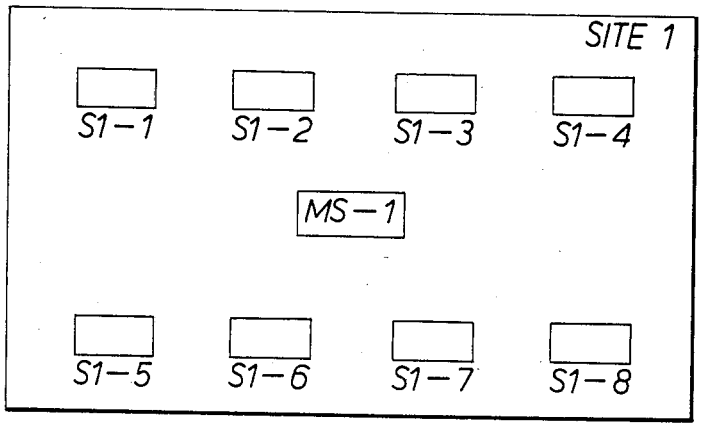
FIG. 1 is a block diagram of several different installations in one of the systems the different installations being labeled 1(*a*),1(*b*) and 1(*c*)
Figure 1B:
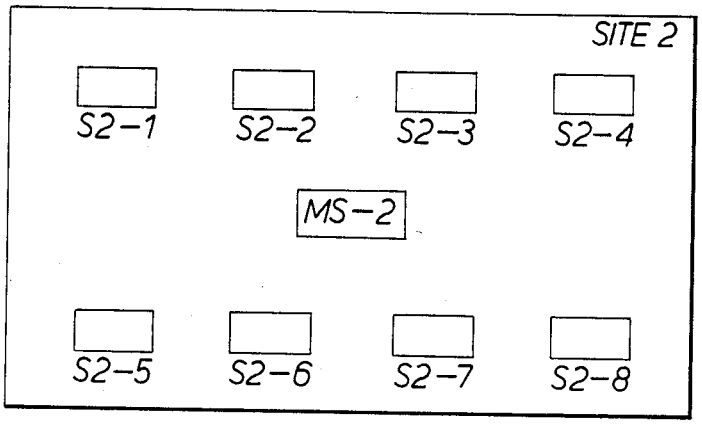
Figure 1C:
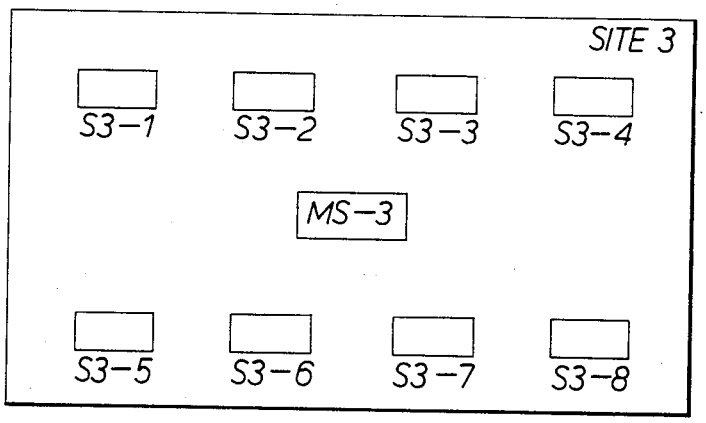

FIG. 1 shows two of the security installations on two sites, Site 1 and Site 2 these Sites being shown at 1(*a*) and 1(*b*) in FIG. 1 respectively. Sites 1 and 2 may be adjacent apartments for example. Each installation comprises a plurality of sensors S1-1, S1-2 . . . S1-8 (for Site 1) and S2-1, S2-2 . . . S2-8 (for Site 2) and a respective master station, MS1 (for Site 1) and MS2 (for Site 2).

Figure 2:
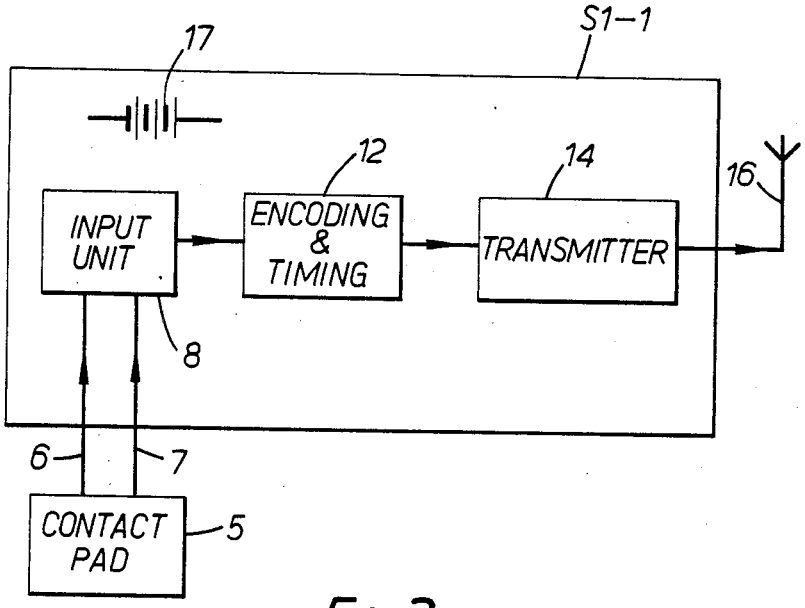
FIG. 2 is a diagram of blocks of digital data forming signals transmitted in the system.

Each sensor is arranged to sense a particular occurrence, for example the presence of an intruder or fire or smoke, or escape of gas or water and may employ any suitable means for doing this and producing a corresponding electrical signal. As shown diagrammatically in FIG. 2, one such sensor (sensor S1-1 for example) may therefore comprise a contact pad 5 in the form of a thin mat which is placed under a floor covering near a door or window so that the weight of an entering intruder closes a pair of contacts and thus closes the circuit between a pair of lines 6 and 7, producing an electrical signal to an input unit 8. The resultant signal is encoded by an encoding and timing unit 12 and passed to a radio transmitter 14 for transmission, by radio, to the appropriate master station, MS1, by means of a transmitting antenna 16. The whole arrangement would be designed to be as small and unobtrusive as possible. A battery 17 provides power, the power supply connections being omitted.

Figure 3:
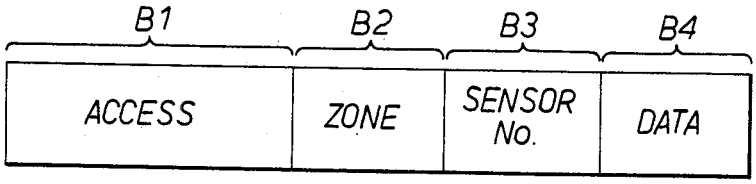
FIG. 3 is a block circuit diagram of a sensor used in the system.

Advantageously, the transmitted signal is transmitted in digital form. FIG. 3 shows one form which the transmitted signal may take.

The signal comprises a first block, B1, which is termed the access code and may be in the form of eight bits. The access code identifies the particular installation, that is, it identifies the sensor as belonging to Site 1 or Site 2 in this example. The next part of the signal is a block B2 in the form of a zone code of four bits identifying the zone within the site in which the particular sensor is located, for example the particular room. Block B3 of the signal also comprises four bits and is the sensor code identifying the particular sensor.

Finally, the block B4, again of four bits, is the actual data, that is, the information about the state of the contact pad 5 in this particular example.

The access code (block B1) therefore ensures that each master station only responds to its "own" sensors, that is, sensors of its site. The encoding and timing unit 12 in each sensor is therefore pre-programmed to prefix the data which it transmits with the appropriate access, zone and sensor codes.

Each master station is also pre-programmed so as to respond only to data prefixed by the access code corresponding to the site in which it is situated, and in this way is prevented from incorrectly responding to data transmitted by the sensors in adjacent sites which will, of course, be prefixed by different access codes.

Figure 4:
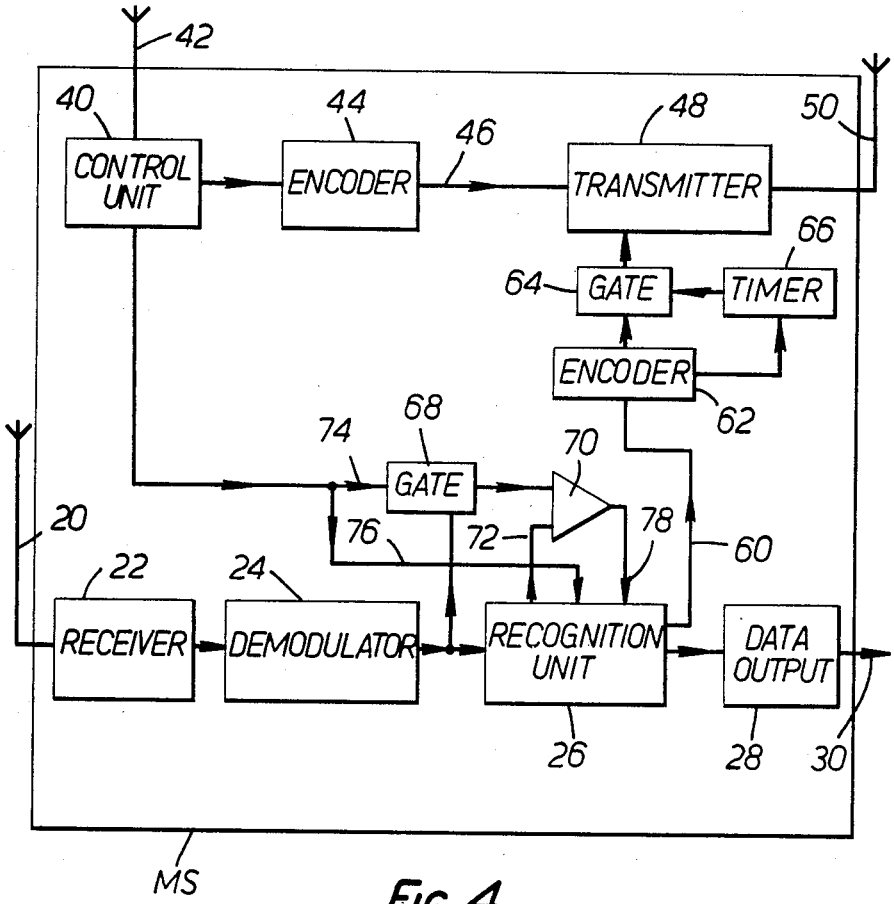
FIGS. 4 and 5 are block circuit diagrams of different forms of master station which can be used in the system.

FIG. 4 shows the master station in block diagram form. It has a receiving antenna 20 and receiving circuitry 22 for receiving and processing radiated digital signals from the sensors in its site (and which will also respond to signals transmitted by sensors in adjacent sites). The received signals are then passed to a demodulating unit 24 which demodulates the radio signal into digital form and will reject radio signals of incorrect format (e.g. signals which are transmitted by modulation of a different form and which originate from other neighbouring radio sources). The demodulated signals are then passed to a recognition unit 26 which checks the access code of the received signals with the pre-programmed access code for that Site. If recognition takes place, the signals are then passed to a data extraction unit 28 which extract the data part of the transmitted signals and outputs an appropriate output message on a line 30 which would normally comprise the identity of the sensor and its state.

Line 30 would be connected to appropriate equipment for responding accordingly, such as for giving an audible or other form of alarm and/or transmitting the signal to a distant location.

In order for the system to operate in the manner described, it is clearly necessary for the access code used by each Site to be different from the access code used by all adjacent Sites within radio range. It is a relatively simple matter to ensure this if all the installations are installed at the same time, for example during construction of the building in which they are situated. In practice, however, this will certainly not always be the case. In accordance with the feature of the system being described, therefore, a new installation is capable, automatically, of selecting its access code to be different from the access code of any already-existing installation within radio range.

For this purpose, each master station includes transmitting circuitry, in addition to the receiving circuitry already described.

As shown in FIG. 4, each master station includes a control unit 40 which can be manually activated, via a line 42, to cause an encoder 44 to produce an encoded digital signal on a line 46. This digital signal is in the form of a code which is similar in format to the access code of block B1 in FIG. 3 but has a predetermined format recognisable by all master stations. The digital signals on line 46 representing this code, which is referred to as "the system code", control the modulating circuitry in a transmitter 48 and the resultant signals are transmitted by a transmitting antenna 50.

When a new installation is to be commissioned, for example an installation in Site 3 (see 1(*c*) in FIG. 1), the installer initially sets the access code of the newly installed master station (MS3 in this example) to a randomly selected value, and this he enters into the recognition unit 26 (FIG. 4) by means of manual controls not shown. He then activates control line 42 (see FIG. 4) and the master station thus transmits the system code to the other installations (Sites 1 and 2 in this case) within radio range.

The system code will be received by master stations MS1 and MS2 and, after demodulation, will be passed to their respective recognition units 26 which are programmed to respond to it (in addition to being programmed to respond to their respective access codes as already explained). In response to recognition of the system code, the recognition unit 26 (FIG. 4) in each master station MS1 and MS2 outputs its respective access code via a line 60 to an encoder 62 which passes it to the transmitter 48 via a gate 64. When gate 64 is opened, by a timer 66, the encoded access code is transmitted by the transmitter 48, via antenna 50, back to the new master station MS3.

The purpose of the gate 64 is to prevent all the already-installed master stations within radio range from transmitting their access codes simultaneously to the new master station. This is achieved by means of timer 66 which opens gate 64 after a time delay which, in each master station, is made to be dependent on the number value of the respective access code. In the example being considered where the access codes have eight bits, there are 256 different access codes, and the time delays imposed by the respective timers 66 depend on the position in the series 1 to 256 of the respective access codes.

In the new master station, MS3 in this example, the access codes of the already-installed master stations are therefore received serially at antenna 20 (FIG. 4). After demodulation by the demodulator 24 they are passed via a gate 68 to one input of a comparator 70. The other input of the comparator 70 is fed with the initially set value of the access code for the new master station, by means of a line 72. Gate 68 and the recognition unit 26 are controlled for this purpose during the setting-up process by signals on lines 74 and 76 from the control unit 40.

If the comparator 70 detects equality between an incoming access code and the initially set value of the access code in recognition unit 26, it produces a signal on a line 78 which increments the access code to the next value in the series 1 to 256. The process described continues.

If the comparator 70 determines that the incremented access code is the same as the next incoming access code, a resultant signal on line 78 increments the access code in the recognition unit 26 again. This continues until the access code has been set to a value different from those of all the master stations within radio range.

This code is displayed to the installer in any suitable way who can then physically set the encoding units 12 of all the sensors which he is installing to the same access code.

Because the already-installed master stations are transmitting their access codes in numerical order of access code to the newly installed master station, it follows that once the serial number of the next access code being received by the new master station exceeds the serial number of the access code currently in the recognition unit 26, the process can be halted-since the serial numbers of the access codes of all the master stations which have yet to transmit their access codes to the new master station will be higher.

It will be appreciated that the detailed forms of the sensors and master stations described and illustrated are merely shown by way of example, and the concepts described may be implemented in many other ways.

For example, instead of initially setting the newly-installed master station to an arbitrarily or randomly selected access code, no such selection may take place and, instead, each access code received (from the already-installed master stations) may be fed into a store (replacing comparator 70, FIG. 4). When all such access codes have been received, the new master station selects its own access code to be different from all those stored.

Figure 5:
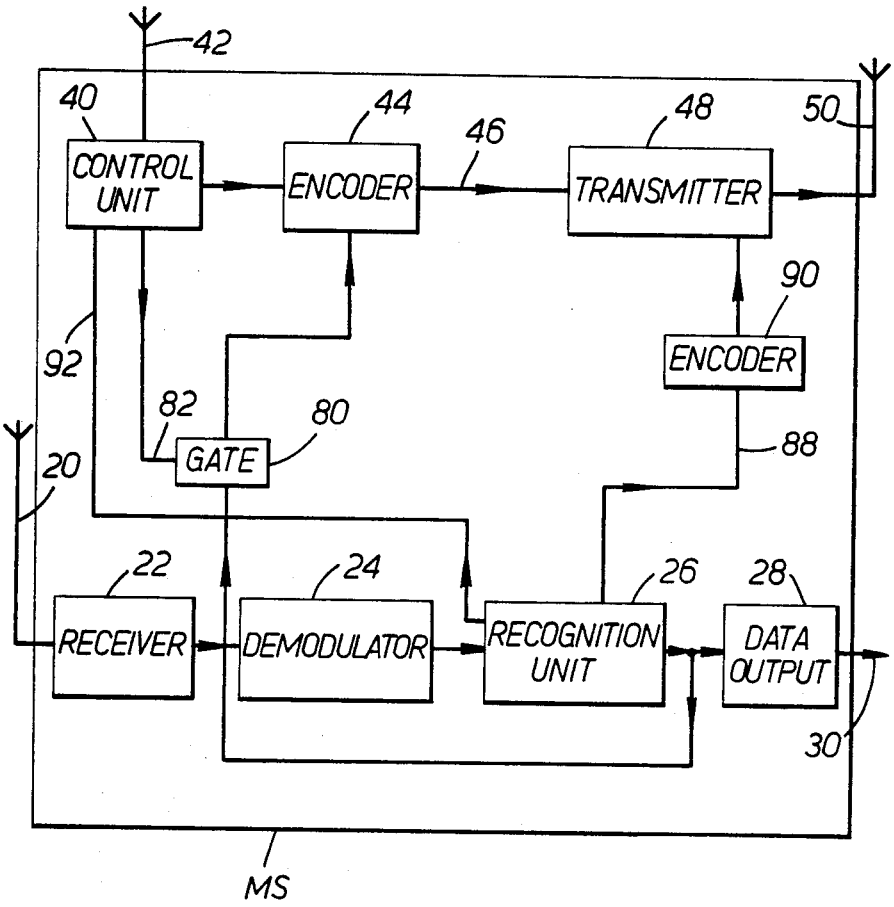

In another modification, a newly-installed master station is arranged to transmit not a system code but an initial value of access code (which would have been selected arbitrarily or randomly as described above). The access code would be followed by a system code replacing the zone and sensor number blocks (Block B2 and B3, FIG. 3). Each already-installed master station would therefore only detect the transmitted access code if its own access code is the same. When such an already-installed master station did detect its own access code, it would then decode the rest of the transmitted information and thus determine, from the decoded system code, that the transmission was a test transmission. It would therefore transmit information back to the new master station indicating that the initially selected value for the access code was already in use. The new master station therefore changes its initially selected access code and repeats the process and this continues until no already-installed master station responds to transmission of this code. This method has the advantage of potentially being faster than the method previously described not all the already-installed master stations have to transmit back to the new station. FIG. 5 illustrates a form of master station which can be used to implement the method described above. Items in FIG. 5 corresponding to those in FIG. 4 are similarly referenced.

Initially, the recognition unit 26 of the new master station is set to an arbitrarily selected access code. When the control unit 40 is activated via line 42, this access code is passed via a gate 80, controlled by line 82 from the control unit 40, to the encoder 44 and transmitted to all already-installed master stations.

Each master station receives the transmission in the manner explained. If one of them has the same access code as the access code transmitted by the new station, this will be recognised by its recognition unit 26. However, the latter will also recognise that the immediately following data is the system code (instead of data relating to the identity of a sensor and its state). The master station responds to the system code by energising a line 88 which activates an encoder 90 to cause transmitter 48 to transmit an appropriate signal back to the new master station.

At the new master station, the recognition unit 26 responds to this signal by changing its access code and signalling to the control unit 40, via a line 92, to repeat the procedure described. This continues until the new master station has selected a value for its access code which provokes no response from any already-installed master station.

Various modifications of this system described with reference to FIG. 5 may be made. For example, the system code may be transmitted first, immediately followed by the arbitrarily selected access code. All master stations will react to the system code and go into a mode in which they inspect the immediately following access code to check whether it agrees with theirs, and transmit an appropriate response back to the new master station accordingly.

The functions described above as being performed by the new master station in order to interrogate already-installed master stations and thereby to select an unused access code for the new station can instead be performed by a special purpose transmitter unit used by the installer.

Many other modifications are possible.

Although the systems described have used radio transmission, the features of the systems may also be used where the mode of transmission is different, but in which there is a similar problem of possible mutual interference between adjacent installations: for example, by means of infra-red radiation, ultrasonic vibrations or any other suitable means, including also by means of wired link systems, in particular AC line carrier systems, that is where transmission is by the power supply mains.

What is claimed is:

1. A remote sensing system, in which a first group of remote units are associated with a master station for transmitting information to that master station and are for installation within reception range of one or more other master stations each having associated therewith a respective further group of remote units, each remote unit of each such further group transmitting information to its respective master station, the information transmitted by the remote units of each said further group being identified with a respective access code which is recognizable only by the master station associated with those remote units, the system including monitoring means connected to the first master station and operative to cause the access code applicable to each of the said further groups to be monitored by radio, and selecting means connected to the monitoring means and responsive to the monitored access codes for selecting a different value of access code for the first master station.

2. A system according to claim 1, in which the monitoring means comprises system code transmitting means operative to transmit to all master stations within reception range a system code which is recognisable by all those master stations, and means within each master station for detecting the system code and responding thereto by transmitting back its own access code.

3. A system according to claim 2, in which the selecting means comprises means for sensing all the transmitted-back access codes and selecting a different code for the first-mentioned master station.

4. A system according to claim 1, in which each master station includes timing means responsive to receipt of the system code for causing the transmission back of its own access code at a predetermined time which is different for each such master station.

5. A system according to claim 1, in which the monitoring means comprises transmitting means operative to transmit to all master stations within reception range a code representing a current value selected for the access code for the first-mentioned master station, and means within each master station receiving that code to transmit back a recognition signal indicating if its own access code is the same as the said current value.

6. A system according to claim 5, in which the selecting means comprises means for responding to the or each such recognition signal by changing the current value to a different current value, and means for re-operating the monitoring means.

7. A system according to claim 1, in which the said transmitting means of the monitoring means is situated within the first-mentioned master station.

8. A method of preventing interference between adjacent installations each comprising a respective group of remote stations which transmit information to a respective master station by means of signals which are identified by an access code, comprising the steps of causing the access codes of all installations within reception range of the location of a proposed new installation to be automatically monitored, and sensing the monitored access codes and responding thereto by automatically selecting for the proposed new installation a value of access code which is different from the monitored access codes.

9. A method according to claim 8, in which the monitoring step comprises the step of transmitting from the said location a system code which is recognisable by the master stations of all the adjacent installations and which causes them to transmit their access codes back to the said location for monitoring there.

10. A method according to claim 9, in which the selecting step includes the steps of arbitrarily choosing an initial value for the access code of the proposed new installation, comparing this arbitrarily selected value with the values of the transmitted-back access codes, and changing the arbitrarily selected value until it is different from all the transmitted-back access codes.

11. A method according to claim 9, in which the selecting step includes storing all the transmitted-back access codes, and selecting a value of access code which is different from the stored access codes.

12. A method according to claim 8, in which the said monitoring step comprises the steps of transmitting from the said location a code representing a current value selected for the access code for the proposed new installation, determining at each master station whether the access code thereof is the same as the said current value and, if so, transmitting information accordingly back to the said location.

13. A method according to claim 12, in which the selecting step comprises the step of responding to the said transmitted information by changing the said current value to a different current value and repeating the said monitoring step.

14. A method according to claim 8, in which the mode of transmission used is radio transmission.

15. A method according to claim 8, in which the mode of transmission is by means of infra-red radiation.

16. A method according to claim 8, in which the mode of transmission is by means of wired links.

17. A method according to claim 16, in which the wired links are formed by an AC mains system, that is where transmission is via the power supply means.

* * * * *